US009676105B2

(12) United States Patent
McChesney

(10) Patent No.: US 9,676,105 B2
(45) Date of Patent: Jun. 13, 2017

(54) SYSTEMS, DEVICES, AND/OR METHODS FOR MANAGING AN ASSISTED OPENING RETRACTABLE KNIFE

(76) Inventor: Richard Wayne McChesney, Staunton, VA (US)

( * ) Notice: Subject to any disclaimer, the term of this patent is extended or adjusted under 35 U.S.C. 154(b) by 1117 days.

(21) Appl. No.: 13/471,936

(22) Filed: May 15, 2012

(65) Prior Publication Data

US 2013/0305542 A1 Nov. 21, 2013

(51) Int. Cl.
*B26B 1/08* (2006.01)

(52) U.S. Cl.
CPC ..... *B26B 1/08* (2013.01); *Y10T 29/49* (2015.01)

(58) Field of Classification Search
CPC ..... B26B 1/08
USPC ..... 30/162, 154, 339, 335
See application file for complete search history.

(56) References Cited

U.S. PATENT DOCUMENTS

| | | | | |
|---|---|---|---|---|
| 35,964 | A | 7/1862 | Wisner | |
| 57,902 | A | 9/1866 | Hibbard | |
| 110,986 | A | 1/1871 | Lyman | |
| 174,417 | A | 3/1876 | Evans | |
| 187,051 | A | 2/1877 | Scholfield | |
| 191,063 | A | 5/1877 | Whitehouse | |
| 242,985 | A | 6/1881 | Rischow | |
| 243,071 | A | 6/1881 | Kayser | |
| 2,550,847 | A | 4/1882 | Fiske | |
| 286,209 | A | 10/1883 | Lincoln | |
| 292,917 | A | 2/1884 | Kaldenbach | |
| 307,767 | A | 11/1884 | Heysinger | |
| 309,863 | A | 12/1884 | McGovern | |
| 317,208 | A | 5/1885 | Rockwell | |
| 338,612 | A | 3/1886 | Pusey | |
| 407,863 | A | 7/1889 | Hunt | |
| 456,087 | A | 7/1891 | Franklin | |
| 457,306 | A | 3/1892 | Franklin | |
| 470,777 | A | 3/1892 | Billings | |
| 472,104 | A | 4/1892 | Von Bultzingslowen | |
| 5,481,804 | A * | 1/1996 | Platts | A61B 17/3211 30/162 |
| 5,569,282 | A * | 10/1996 | Werner | A61B 17/3211 30/162 |
| 5,620,454 | A * | 4/1997 | Pierce | A61B 17/32 30/162 |
| 7,346,989 | B2 * | 3/2008 | Shi | A61B 17/3213 30/151 |
| 7,797,838 | B2 | 9/2010 | Chu | |
| 8,413,339 | B2 * | 4/2013 | Ranieri | B26B 5/002 30/162 |
| 8,595,941 | B2 | 12/2013 | Lee | |
| 8,819,943 | B2 * | 9/2014 | Maxwell | A61B 17/3211 30/162 |
| 2003/0093905 | A1 * | 5/2003 | Dambal | A61B 17/3211 30/162 |

(Continued)

*Primary Examiner* — Andrea Wellington
*Assistant Examiner* — Fernando Ayala
(74) *Attorney, Agent, or Firm* — Dale Jensen, PLC; Dale Jensen

(57) ABSTRACT

Certain exemplary embodiments can provide a retractable blade knife, which can comprise a handle and a blade. The handle can comprise a top handle scale operatively coupled to a bottom handle scale via a plurality of fasteners. The retractable blade knife can comprise a large coil spring adapted to cause the blade to thrust out from a first partially extended position to a second partially extended position.

18 Claims, 13 Drawing Sheets

(56) References Cited

U.S. PATENT DOCUMENTS

2007/0175045 A1* 8/2007 McHenry ..... B26B 1/08
30/162
2010/0325899 A1* 12/2010 Seber ..... B26B 5/001
30/162

* cited by examiner

SYSTEMS, DEVICES, AND/OR METHODS FOR MANAGING AN ASSISTED OPENING RETRACTABLE KNIFE

BRIEF DESCRIPTION OF THE DRAWINGS

A wide variety of potential practical and useful embodiments will be more readily understood through the following detailed description of certain exemplary embodiments, with reference to the accompanying exemplary drawings in which.

DETAILED DESCRIPTION

Certain exemplary embodiments provide a retractable blade knife, which can comprise a handle and a blade. The handle can comprise a top handle scale operatively coupled to a bottom handle scale via a plurality of fasteners. The retractable blade knife can comprise a large coil spring adapted to cause the blade to thrust out from a first partially extended position to a second partially extended position.

Certain exemplary embodiments provide a single action assisted opening knife. In certain exemplary embodiments, the blade of the knife can be manually retracted. Certain exemplary embodiments can provide a handle that can be fully gripped when opening the knife to expose the blade.

Certain exemplary embodiments provide a blade key retracting system. Using this system an assisted opening can be achieved three ways.

By placing the middle and index fingers on the bottom side just above the end of the pocket clip. The thumb will be approximately on the middle of the top of the handle. The butt end of the knife's handle will be approximately in the middle of a palm of a user. The user can then make a pinch grip, pushing in the blade tang to assist in opening the blade.

By fully grasping the handle and pushing the blade tang against the user's hip, the blade can be opened.

By fully grasping the handle in the reverse grip and pushing the blade tang with the user's thumb, the blade can be opened.

Certain exemplary embodiments provide a knife in which the only incline is a milled ramp into the top of the aluminum handle scale (top side). Other suitable materials can be used to make exemplary knives including, for example, a molding of zytel® (zytel is a trademark of E.I. du Pont de Nemours and Company), plastic, aluminum, and/or other metals. Also, the top handle scale comprises a milled out slot for an assembly with an angular pin connection that fits into the blade's hole (no notches).

Figure 4:
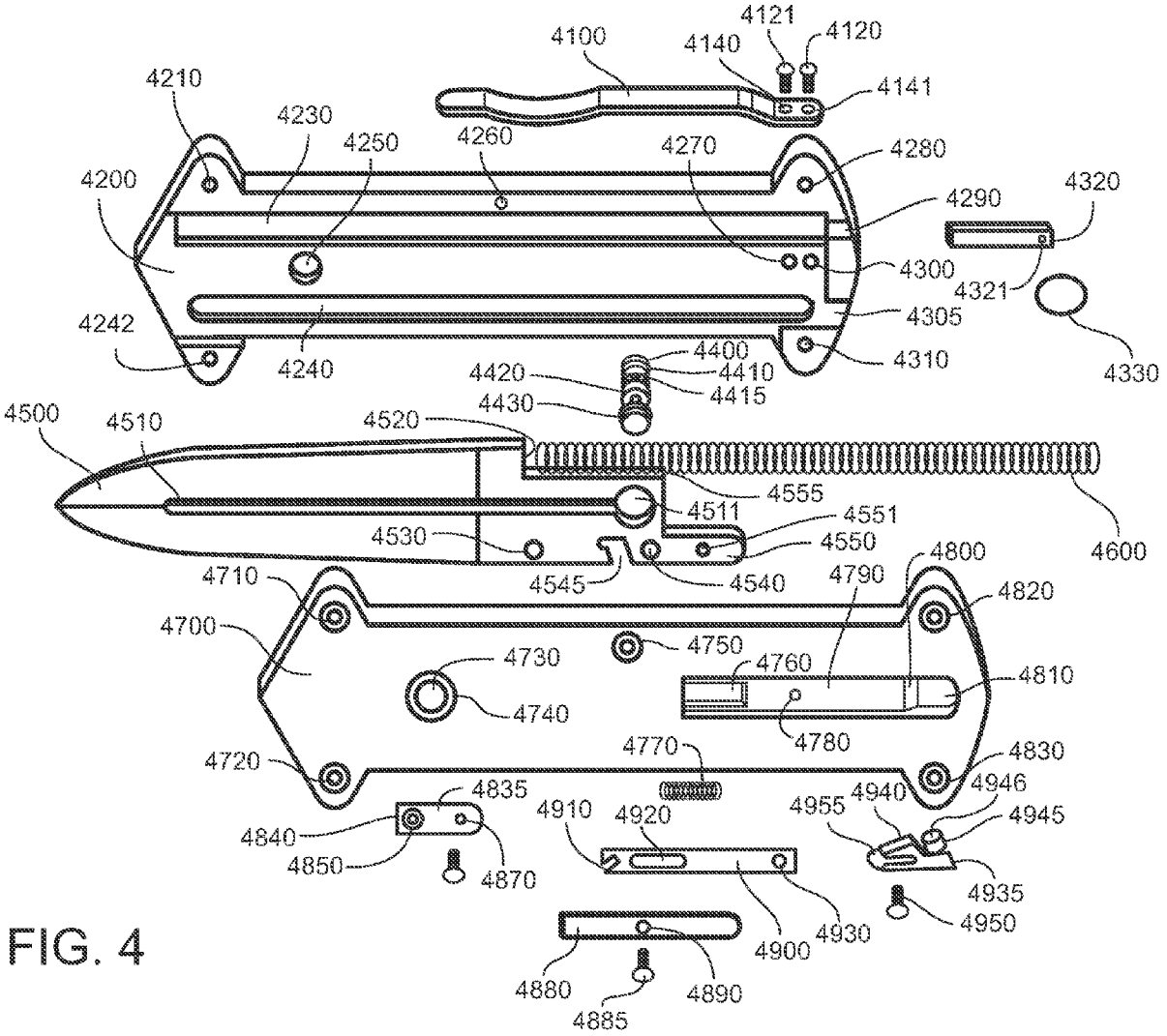
FIG. 4 is an exploded perspective view of an exemplary embodiment of an assisted opening knife 4000.

FIG. 4 is an exploded perspective view of an exemplary embodiment of an assisted opening knife 4000. Assisted opening knife 4000 comprises a blade 4500, which defines an aperture 4510. Aperture 4510 has a generally slotted appearance and can be rounded at both ends of the slot. A first end of the slot can define a partial bulb 4511 of aperture 4510 (which can define a partial hole having a diameter of approximately 0.75 inches in certain exemplary embodiments). Partial bulb 4511 has a larger width than the width of the remainder of the slot. Partial bulb 4511 of aperture 4510 can be adapted to receive an end of button posterior end 4410. In operative embodiments, button 4430 can extend through button aperture 4730 (see also button aperture 5140 of FIG. 5). Button aperture 4730 can be counter bored 5141 (see FIG. 5) on a bottom inner side so that rim 4420 will be restrained from further travel once a predetermined depth is reached. In certain exemplary embodiments, there can be sufficient clearance in button aperture 4730 so that rim 4420 can move up and down when button 4430 is depressed. The stop depth for rim 4420 prevents button 4430 from traveling fully through aperture 4730 of an inner top handle scale 4700. Rim 4420 also acts as a stop against the top outer circle of the partial bulb 4511 when depressing button 4430, so as to keep the shaft 4415 slidably in line with the aperture 4510 after button posterior end 4410 of button 4430 exits the bottom side of partial bulb 4511. Button aperture 4730 can comprise a top side bevel countersink 4740 for easier depression of button 4430 with the user's thumb. Button posterior end 4410 is adapted to be partially surrounded by partial bulb 4511 of aperture 4510.

In operative embodiments, shaft 4415 of button 4430 is adapted to slidably move in the slot of aperture 4510. Button 4430 comprises button posterior end 4410, which defines a slot that is cupped out (not shown). A cone shape coil spring 4400, which can be a no. 4 spring, fits into the slot that is cupped of button posterior end 4410 of button 4430. Button posterior end 4410 and coil spring 4400 are adapted to slidably fit into the aperture 4250 of the inner side of bottom handle scale 4200.

Blade 4500 can comprise two pins 4530 and 4540 that each protrudes from opposing surfaces of a posterior portion of blade 4500. When installed in an operative embodiment, the bottom extended ends of pins 4530 and 4540 (not shown)—(see also pin 4530 and pin 4540 of FIG. 6,) are adapted to fit into and slide within a track groove 4240 of bottom handle scale 4200. When installed in an operative embodiment, the top ends of pins 4530 and 4540 that are shown, are adapted to fit into and slide within a parallel matching track groove (not shown in FIG. 4, see track groove 5120 of FIG. 5) of inner top handle scale 4700.

Large coil spring 4600 fits into groove track 4230 of bottom handle scale 4200; also like pins 4530 and 4540, a top groove track of inner top handle scale 4700 substantially surrounds half of large coil spring 4600 when system 4000 is fully assembled. When system 4000 is assembled, large coil spring 4600 is substantially enclosed by the top groove track of inner top handle scale 4700 (see also groove 5110 of FIG. 5) in combination with groove track 4230 of bottom handle scale 4200. When system 4000 is assembled, a forward end of the large coil spring 4600 is adapted to push face 4520 of the blade 4500 to extend blade 4500 to an open position.

Figure 12:
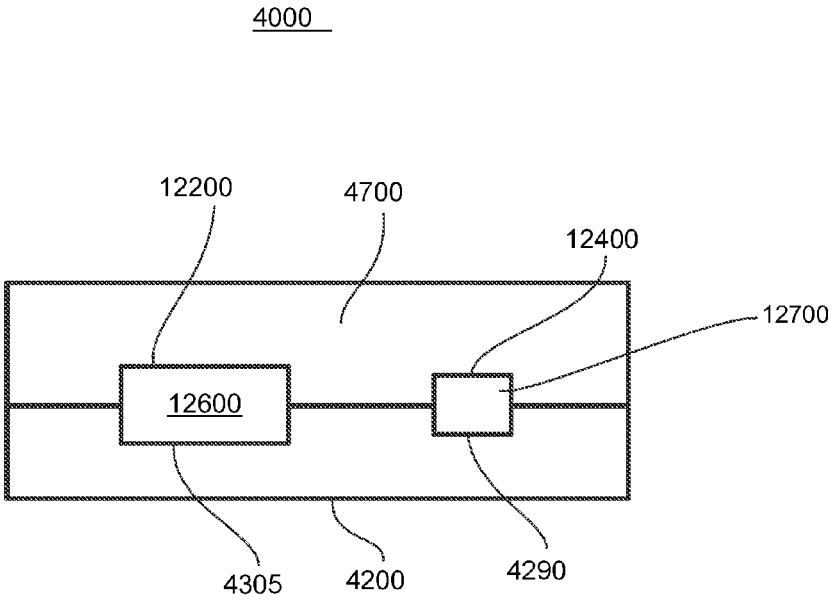
FIG. 12 is an enlarged butt end view of an exemplary embodiment of an opened blade knife 4000 showing a blade tang slot and a retracting key storage slot.

Blade tang 4550 is adapted to fit into a groove 4305 defined by bottom handle scale 4200 and a corresponding opposing groove of inner top handle scale 4700 (illustrated as groove 12200 in FIG. 12). Retracting key 4320 is adapted to fit relatively tightly into groove 4290 defined by bottom handle scale 4200 and corresponding opposing groove of the inner top handle scale 4700 (illustrated as groove 12400 in FIG. 12) then through an end of large coil spring 4600 at a butt end of system 4000 for storage until a user decides to operatively use retracting key 4320. In operative embodiments of system 4000, when blade 4500 is extended, retracting key 4320 can be inserted into an aperture defined by bottom handle scale 4200 and inner top handle scale 4700 (see also notch 4545 and locked retracting key 4320 of FIG. 6) and engage with special notch 4545 of blade 4500 to lock blade 4500 in an extended position and restrain motion of blade 4500 relative to bottom handle scale 4200 and inner top handle scale 4700.

Small wire key ring 4330 is adapted to fit into an aperture 4321 (see also aperture 4321 of FIG. 6) defined by retracting key 4320 near a posterior end of retracting key 4320. Small wire key ring 4330 is adapted to prevent retracting key 4320 from sliding fully inside the aperture (see also aperture 12700 of FIG. 12) defined by bottom handle scale 4200 and inner top handle scale 4700. Small wire key ring 4330 can be grasped by the user to pull out retracting key 4320 for use in retracting blade 4500 from an open position to a closed position. Special notch 4545 (see also notch 4545 of FIG. 6) allows the end of retracting key 4320 to catch when tilted back (see engaged locked retracting key 4320 in FIG. 6) and not come out when retracting the blade (see notch 4545 of FIG. 6; see also notch 4545 of FIG. 9 for a side end view of the notch encased into the handle).

Figure 5:
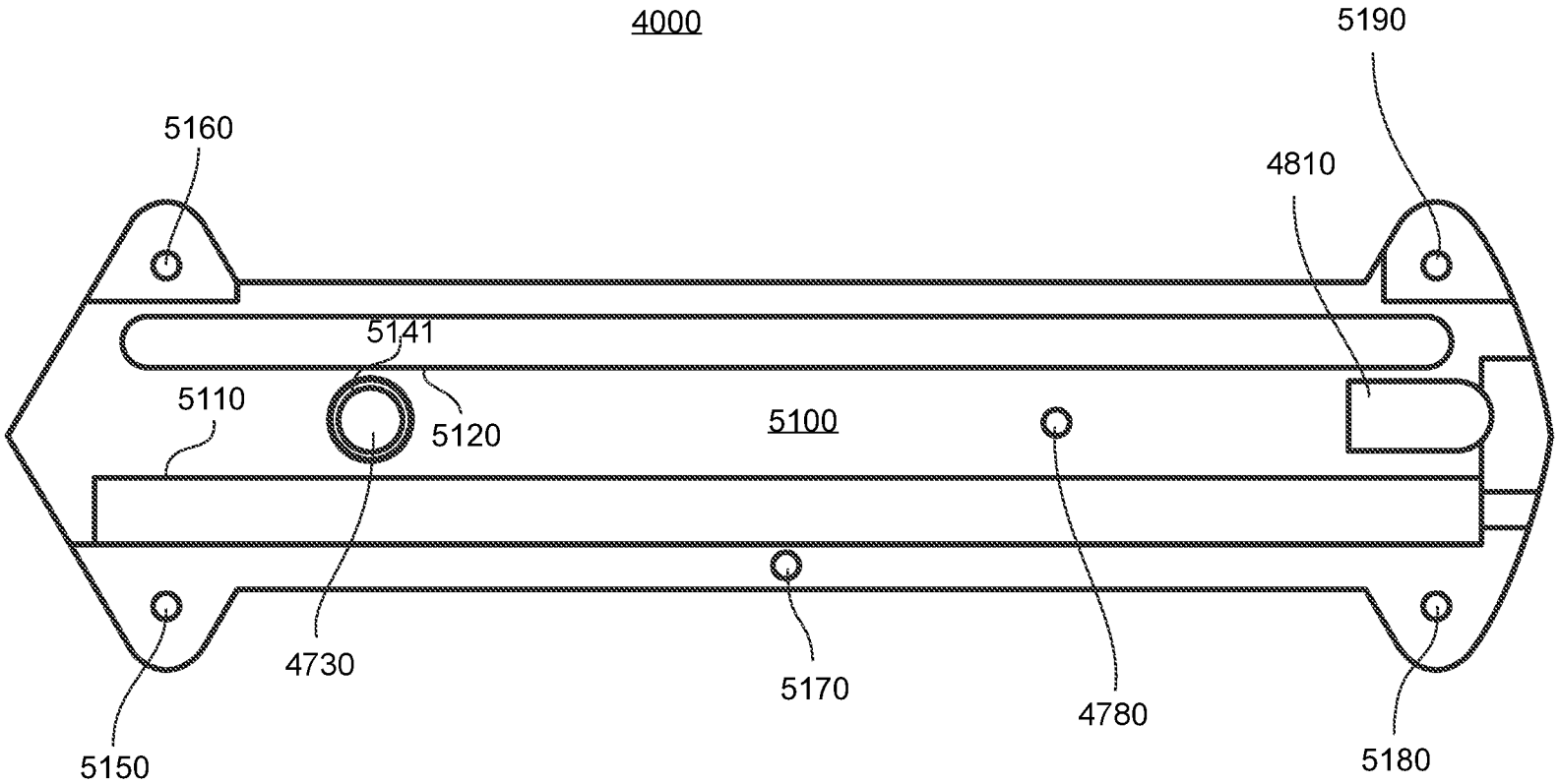
FIG. 5 is an enlarged flat view of an exemplary embodiment of an inner side of a top handle scale 5000.

In operative embodiments, bottom handle scale 4200 and inner top handle scale 4700 can be fastened together and held by torx screws (fillister head) numbers 4710, 4720, 4750, 4820, and 4830 that are fitted into the counter bores (not shown) of the holes in top handle scale 4700 (see FIG. 5 for an illustration of the bottom side of holes 5150, 5160, 5170, 5180, 5190, which side is not counter bored). The torx screws are adapted to turn into threaded holes 4210, 4242, 4260, 4280, and 4310 of bottom handle scale 4200 (see FIG. 8 for the top side of these holes number 4210, 4242, 4260, 4280, and 4310. A top side of top handle scale 4700 defines drilled and counter bored holes to accept fillister heads of the torx screws.

Figure 8:
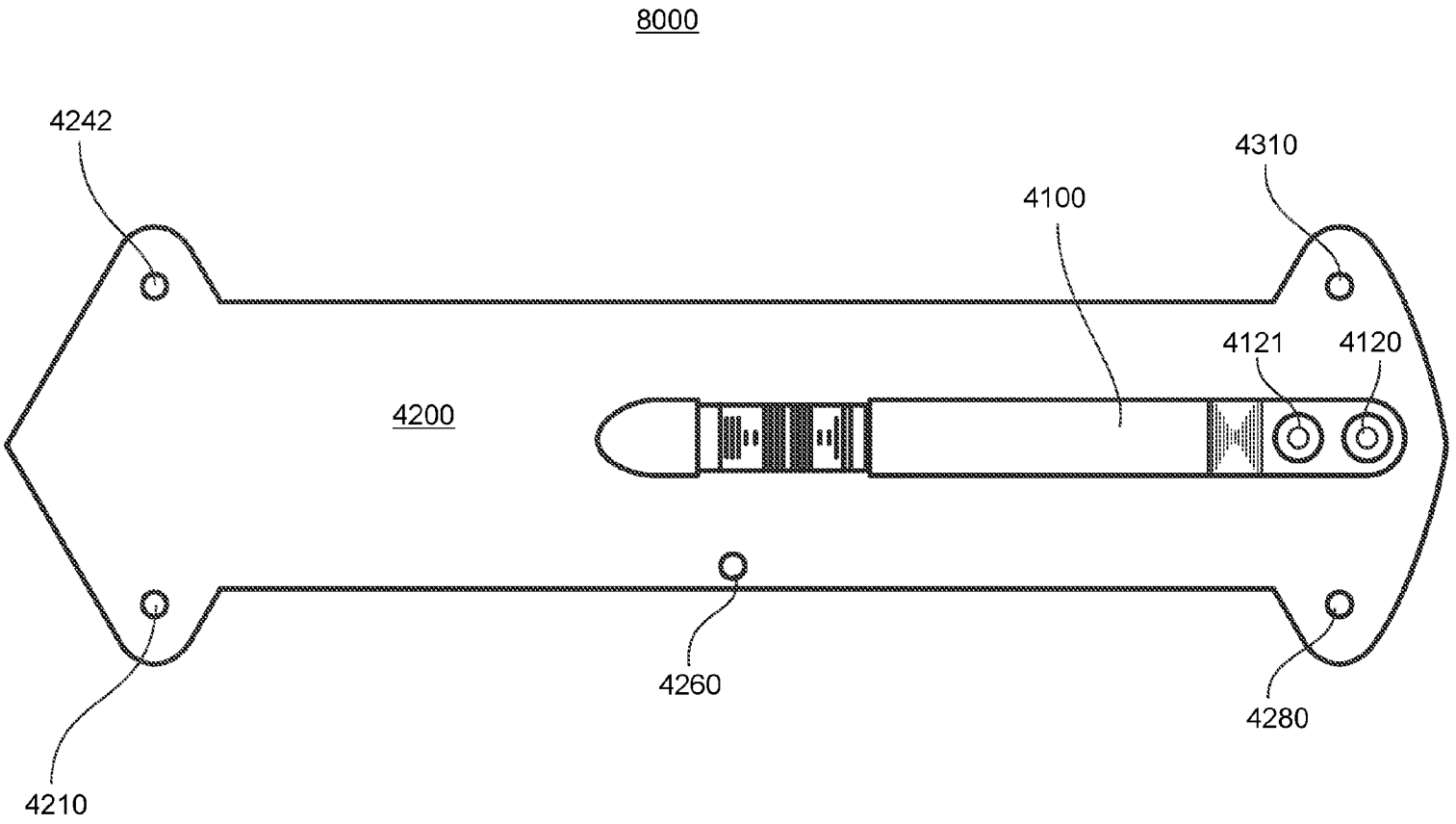
FIG. 8 is an enlarged flat view of an exemplary embodiment of a bottom side of a bottom handle scale system 8000 with a pocket clip attached.

Pocket clip 4100 can be attached to the bottom end (outer side) of bottom handle scale 4200 by screws 4120 and 4121 through the pocket clip holes 4140 and 4141, then through threaded holes numbers 4270 and 4300 of the outer side of bottom handle scale 4200 (see also heads of torx screws 4121 and 4120 in FIG. 8).

Small resetting coil spring 4770 is adapted to fit into a substantially rectangular well 4760 of inner top handle scale 4700. Bottom leaf spring 4900 (sheet metal) has a bent down end 4910 that fits down into the right side of well 4760 to push small resetting coil spring 4770 when pushing blade tang 4550 to activate the assisted opening. Bottom leaf spring 4900 also defines a slot 4920 to enable this activation.

Angle pin connecter 4935 can comprise and/or be operatively coupled to angle pin 4945. In embodiments where angle pin 4945 is operatively coupled to angle pin connector 4935, angle pin 4945 can comprise a threaded end adapted to screw into angle pin connector 4935. At the opposite end, angle pin 4945 comprises a slant 4946 (also see 4861) adapted to enable a levering up of angle pin 4945 over blade end 4555 to allow the angle pin 4945 to enter partial bulb 4511 of aperture 4510 during a blade 4500 retraction process. Thus locking in the assisted opening system 4000. In certain exemplary embodiments, angle pin connecter 4935 and the angle pin 4945 can be an integral (one piece) milling out of stainless tool steel bar (which can be approximately "¼" thick in certain exemplary embodiments). In certain exemplary embodiments, in which the assisted opening mechanism is substantially enclosed with a top (hollowed out) handle grip, angle pin 4945 should be integral with angle pin connecter 4935 because the back end of angle pin connecter 4935 should be cut at an angle downward, thus recessing down into slot 4180 of top handle scale 4700. Such would be the space where angle pin 4860 screws into hole 4870 of angle pin connecter 4935.

Screw 4950 is adapted to pass through a hole defined by angle pin connector 4935, through hole 4930 of bottom leaf spring 4900, and screw into a threaded aperture that extends into a slant portion 4940 of angle pin connecter 4935. An end of bottom leaf spring 4900 first slides into a recessed portion 4955 of angle pin connector 4935 before the screw 4950 is operatively coupled to bottom leaf spring 4900. This whole attached assembly fits into a grooved channel 4790 defined by inner top handle scale 4700. Channel 4790 at its butt end has a ramp 4800 and a slot 4810 that allows slant portion 4940 to slide up ramp 4800 and angle pin 4945 to move in slot 4810 and at the same time lever up out of partial bulb 4511 of blade 4500, thus releasing blade 4500 for opening by large coil spring 4600. Angle pin connecter 4935 can comprise (note: two views of angle pin connector 4935 are provided in FIG. 4—one angle pin connector 4935 is used in certain exemplary embodiments of assisted opening knife 4000):

a.) top side 4835 of angle pin connector 4935;

b.) threaded hole 4870 (top side), for angle pin 4945 to screw in from the bottom side.

c.) counter bored hole 4840 for the head of screw 4950 to nestle down into.

d.) small threaded hole 4850 (top side threaded), for screw 4950 to screw into.

Figure 3:
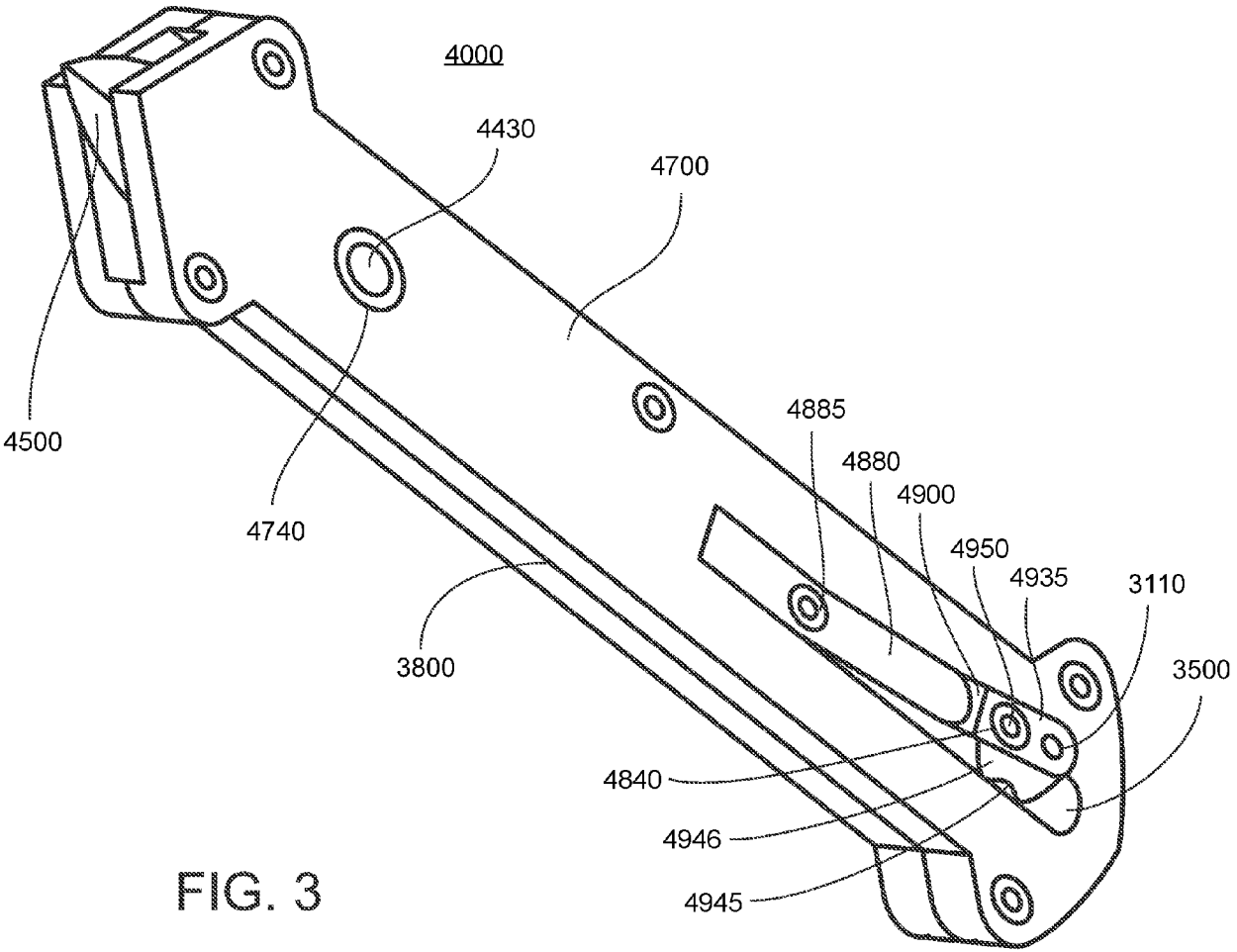
FIG. 3 is an enlarged angle view of an exemplary embodiment of a knife 4000 showing the fourth and final phase of assisted opening.

Also see FIG. 3 for more information regarding angle pin connecter 4935.

Top leaf spring 4880, which can be made of sheet metal spring steel, is adapted to fit directly on a surface of bottom leaf spring 4900. Then, a screw 4885 goes into a hole 4890 defined by top leaf spring 4880, through slot 4920 of bottom leaf spring 4900, and screws into the threaded hole 4780. See also, bottom side 4780 of threaded hole 4780 in FIG. 5. The threads of screw 4885 terminate before reaching the head of screw 4885 and act as a gauge for correct tightness of the assisted opening leaf spring assembly of system 4000, allowing it to work properly when screw 4885 is properly tightened. Screw 4885 can comprise a security head for a security driver and lock threads. Angle pin 4945 can ride up and down against an inner back side of partial bulb 4511. In certain exemplary embodiments, a diameter of angle pin 4945 can be approximately 3/16 inch and a diameter of partial bulb 4511 can be approximately 9/32 inch.

Exemplary materials of construction can be, but are not limited to:

handle scales 4200 and 4700: aluminum;
button 4430: stainless tool steel;
angle pin 4945: stainless tool steel;
angle pin connector 4935: cut bar and milled aluminum (drilled and tapped at an angle;
retracting key 4320: stainless tool steel bar (with a drilled hole);
leaf springs 4880 and 4900: sheet metal spring steel; and/or
pocket clip 4100: stainless spring steel.

Certain exemplary embodiments provide a retractable blade knife, comprising a handle comprising a top handle scale 4700 and a bottom handle scale 4200, the top handle scale 4700 coupled to bottom handle scale 4200 via a plurality of fasteners 4710, 4720, 4750, 4820, and 4830. Top handle scale 4700 defines a button aperture 4730 and a grooved channel. Bottom handle scale 4200 and top handle scale 4700 can be coupled via torx screws.

The retractable blade knife comprises a blade 4500; blade 4500 defining a blade aperture 4510. Blade aperture 4510 defines a slot along a majority of a length of blade 4500. Blade aperture 4510 having a first end that defines a partial bulb 4511 and a second end that is rounded. Blade 4500 comprises a tang 4550. Blade 4500 comprises two pins 4530 and 4540 that each protrudes from both opposing surfaces of a posterior portion of blade 4500. A first set of extended ends of pins 4530 and 4540 are adapted to fit into and slide within track groove 4240 of bottom handle scale 4200. See FIG. 6 for extended ends 4530 and 4540. A second set of extended ends of pins 4530 and 4540 are adapted to fit into and slide within a parallel matching track groove of inner top handle scale 4700. See inner top handle scale groove 5120 of FIG. 5.

The retractable blade knife comprises button 4430, which comprises rim 4420. Button 4430 can be adapted to insert into the partial bulb. Rim 4420 can be adapted to restrain button 4430 from exiting through button aperture 4730 and stopping at the top side of partial bulb 4511 when button 4430 is depressed. When pressed by a user, button 4430 is adapted to cause blade 4500 to extend from a fully retracted position to a first partially extended position. Wherein blade 4500 is substantially enclosed within handle at the first partially extended position. Button 4430 can be adapted to slidably move in blade aperture 4510. Button 4430 can be adapted to be a safety interlock when blade 4500 is in the fully retracted position. Button 4430 can be adapted to engage with a recessed portion of blade 4500 and thereby be a safety interlock when blade 4500 is in the fully retracted position (see recess 6140 of FIG. 6).

Button aperture 4730 can have a top side bevel countersink adapted to facilitate a depression of button 4430 by the user. Button 4430 can comprise button posterior end 4410, which defines a posterior end slot that is cupped out. Button 4730 can comprise a cone shape coil spring 4400 adapted to fit into the slot that is cupped out; wherein button posterior end 4410 and cone shape coil spring 4400 are adapted to slidably fit into a bottom handle scale aperture 4250 defined by bottom handle scale 4200.

The retractable blade knife comprises top leaf spring 4880, bottom leaf spring 4900, and angle pin connecter 4935. Angle pin connecter 4935 comprises slant portion 4940, recessed portion 4955, and angle pin 4945. Bottom leaf spring 4900 is adapted to slide into recessed portion 4955. Angle pin 4945 is adapted to engage blade 4500 via partial bulb 4511 of 4500 blade. Angle pin connector 4935 is adapted to slidably move in grooved channel 4790. A fastener can be adapted to couple recessed portion 4955 of angle pin connector 4935 to bottom leaf spring 4900. Grooved channel 4790 can have ramp 4800 and slot 4810 that allows slant portion 4940 to slide up ramp 4800 and angle pin 4945 to move out of the partial bulb 4511.

The retractable blade knife comprises large coil spring 4600, which can be held and/or partially enclosed within grooved channel 4230. Responsive to the user pressing tang 4550, large coil spring 4600 can be adapted to cause blade 4500 to thrust out from a second partially extended position, a tip of blade 4500 protruding from an opening of the handle at the second partially extended position, to a fully extended position. Large coil spring 4600 can be adapted to push face 4520 of blade 4500 to extend blade 4500 to the fully extended position. When blade 4500 is in the first partially extended position, large coil spring 4600 is restrained from extending by a combination of tension caused by small resetting coil spring 4770, resistance of the ramp, tension of top leaf spring 4880 and bottom leaf spring 4900, and tightness of spacing caused by a combination of a screw and angle pin 4945.

The retractable blade knife comprises retracting key 4320, which can be adapted to be stored in a cavity defined by top handle scale 4700 and bottom handle scale 4200. When stored, retracting key 4320 is partially surrounded by large coil spring 4600. Retracting key 4320 is adapted to engage with special notch 4545 of blade 4500 to restrain motion of blade 4500 relative to bottom handle scale 4200 and top handle scale 4700. Special notch 4545 is adapted to substantially lock retracting key 4320 in position when retracting key 4320 is tilted back such that a longitudinal axis of retracting key 4320 defines an acute angle with a longitudinal axis of the handle. Key ring 4330 can be adapted to be grasped by the user to remove retracting key 4320 from the cavity. The retractable blade knife can comprise a pocket clip 4100, which is adapted to be releasably fastened to an article of clothing of the user. A lanyard can be coupled to key ring 4330. The lanyard can be adapted to be releasably coupled to the pocket clip 4100 as retracting key 4320 is moved from the cavity to special notch 4545.

Small resetting spring 4770 can be adapted to be pushed by a 4910 bent down end of bottom leaf spring 4900 responsive to the user pushing tang 4550. Small resetting spring 4770 can be adapted to push a bent down end of bottom leaf spring 4900 to provide a return force of bottom leaf spring 4900 and angle pin connecter 4935 to an original position, thereby preparing the retractable blade knife such that a user can initiate a blade retracting process.

When blade 4500 is fully retracted, tang 4550 protrudes from a groove that is defined by bottom handle scale 4200 and top handle scale 4700, a hole 4551 in tang 4550 signifying to the user that a safety interlock is in an on position. Note: Blade tang hole 4551 is drilled all the way through. See hole 4551 of FIG. 6; when the blade is fully retracted the 4551 hole is visible, but after the 4430 button is depressed the hole disappears signifying the safety "off" position.

Figure 1:
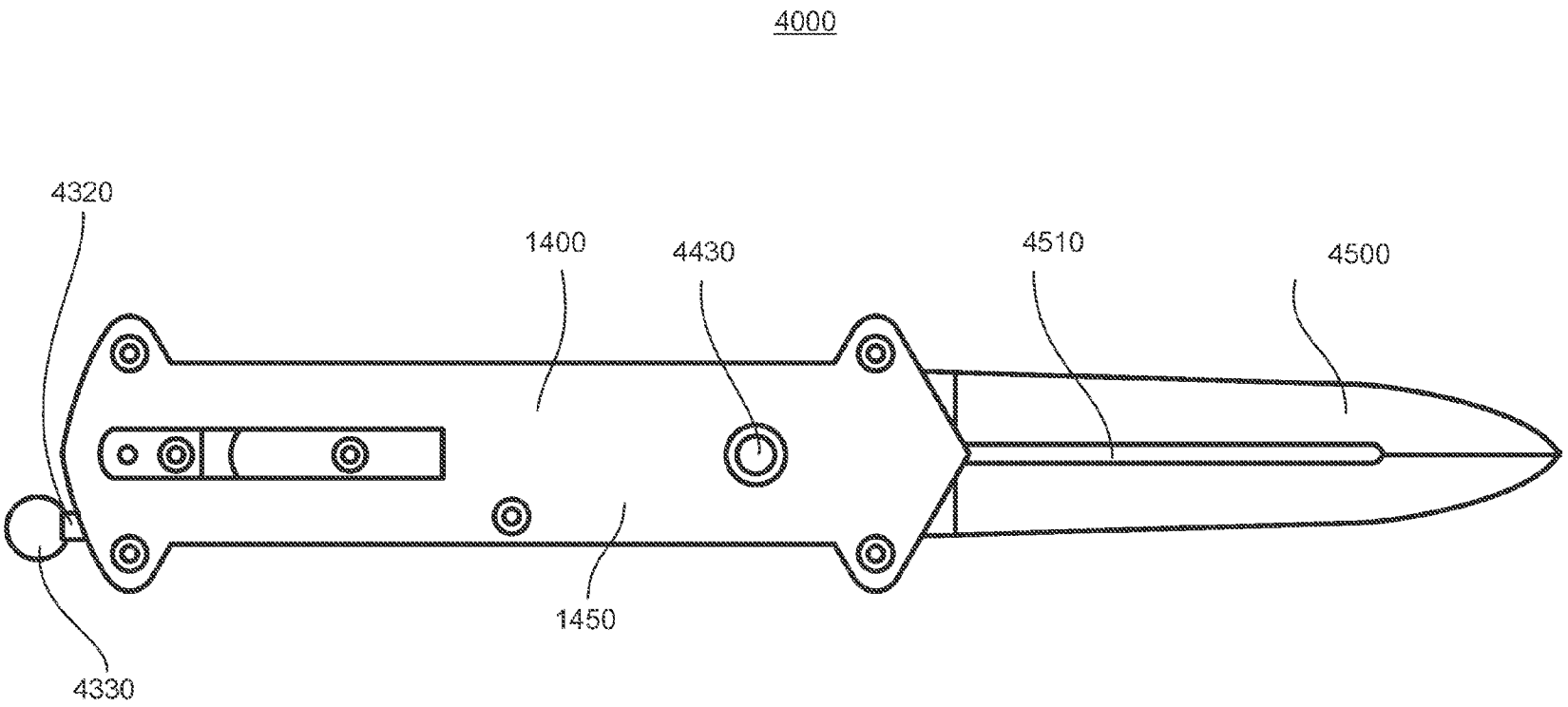
FIG. 1 is a to scale flat view of an exemplary embodiment of a knife 4000 in a fully opened position.
Figure 2:
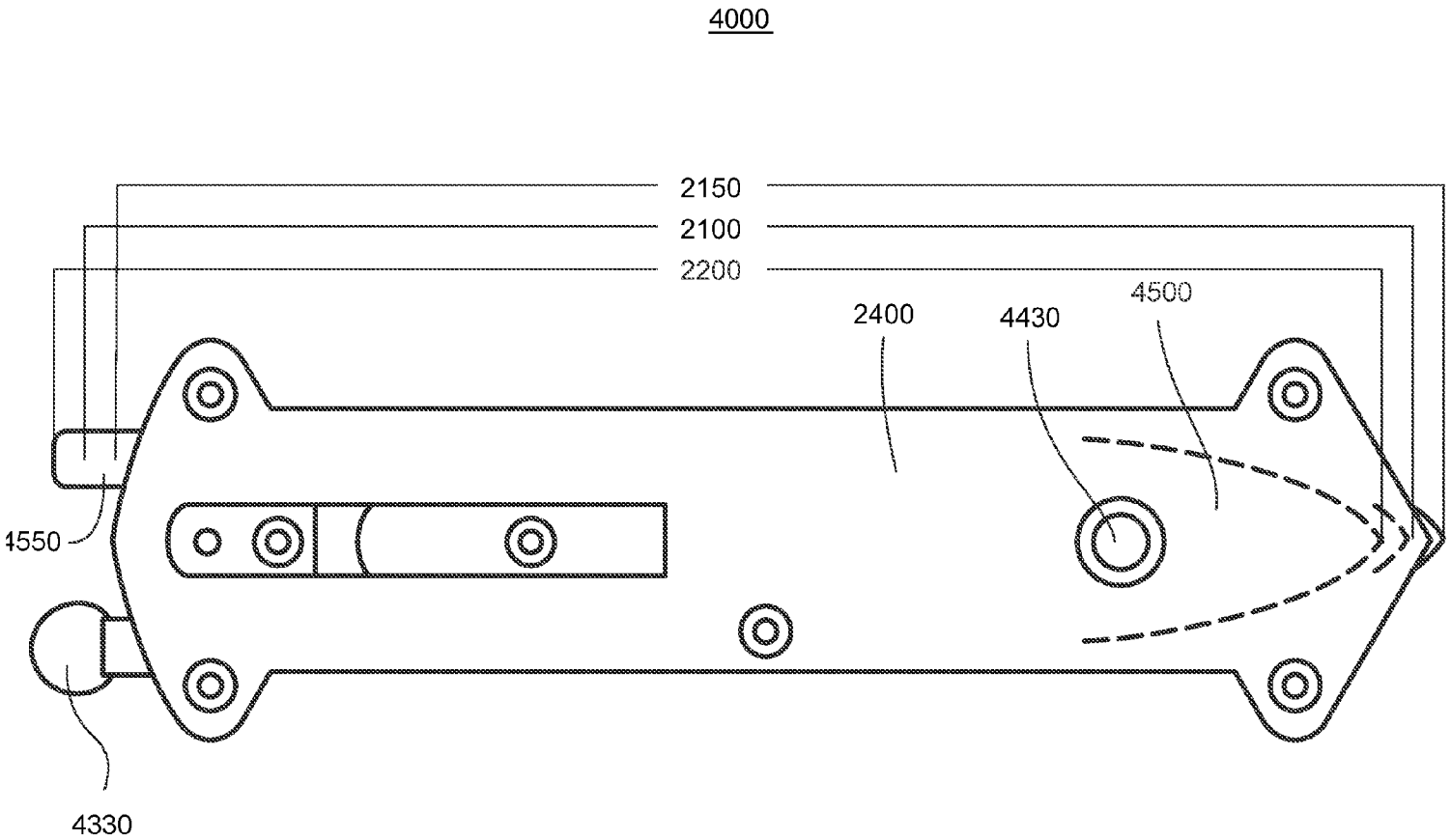
FIG. 2 is a enlarged flat view of an exemplary embodiment of an assembled assisted opening knife 4000 showing the knife's blade point and tang with phantom lines depicting the three of four phases of assisted opening.

FIG. 2 is a plan view of an exemplary embodiment of an assembled assisted opening knife 4000. When depressed, button 4430 is adapted to release a portion of button 4430 from an indented portion of blade 4500 (see, e.g., indented portion 6140 of system 6000 in FIG. 6). As a consequence of depressing button 4430, the point and (tang aligns with butt) of blade 4500 moves from a first position 2200 (illustrated in phantom lines) to a second position 2100 (also illustrated via phantom lines) acting as a push-button safety release. Next, a blade tang 4550 can be depressed in and when the blade's point and tang reaches a third position 2150, which is adapted to release the large coil spring (e.g., large coil spring 4600 as illustrated in FIG. 4), which is adapted to extend blade 4500 to a fully extended position such as is illustrated in FIG. 1. Knife 4000 can comprise a retracting key operatively coupled to a small wire key ring 4330.

In certain operative embodiments, when depressing the blade tang (e.g., blade tang 4550 of FIG. 2 or blade tang 4550 of FIG. 4), slant portion 4940 of angle pin connecter 4935 is adapted to slide up ramp 4800 and causes angle pin 4945 to travel outward from slot 4810 and the partial bulb 4511 of blade aperture 4510. But at an upward position of approximately 9/64 inch above the plane of the top handle scale 4700, (note: 9/64 of an inch is approximately 1/64" more than approximately 1/8" or the approximately thickness of blade 4500. This however would be different in embodiments when blade 4500 is approximately 3/32 inch thick. Also, a shorter 4945 angle pin would release blade 4500 quicker and also can shorten the protrusion of tang 4550 out the butt end slot or have a shorter tang 4550 because of less depressing of it to engage assisted opening). But just before breaking a plane defined by a surface of top handle scale 4700, bottom leaf spring 4900 (rounded end) and a posterior portion of angle pin connecter 4935 (flat end-top side) almost touch when coming together; large coil spring 4600 can then cause blade 4500 to move to a fully extended position, such as is illustrated in FIG. 1. When blade 4500 is fully extended, small resetting coil spring 4770 is adapted to push bent down end 4910 of bottom leaf spring 4900, which provides a motive force adapted to cause angle pin connecter 4935 to retract back (ready for a blade retraction key process).

FIG. 1 is a to scale flat view of an exemplary embodiment of a knife 4000 in a fully opened position, which can comprise a blade 4500 that defines a aperture 4510. In certain exemplary embodiments, a button 4430 can be approximately 1/16 of an inch above a top handle surface 1400 of knife 4000. When button 4430 is locked in either a safety interlock on or an open blade locked position, button 4430 will be above a top handle surface 1400 of knife 4000. In certain exemplary embodiments, when button 4430 is in a recessed position, the knife safety interlock will be off and blade 4500 will be unlocked and can be extended to a full extended position as illustrated. A posterior end (see, e.g., button posterior end 4410 as illustrated in FIG. 4) of button 4430 can engage with an indented portion of blade 4500 (see, e.g., indented portion 6140 of system 6000 in FIG. 6) to lock blade 4500 in a retracted position with the safety interlock on; while the posterior end can enter a partial bulb (see the partial bulb 4511 and aperture 4510 as illustrated in FIG. 4) of an aperture defined by blade 4500 when blade 4500 is extended.

Figure 6:
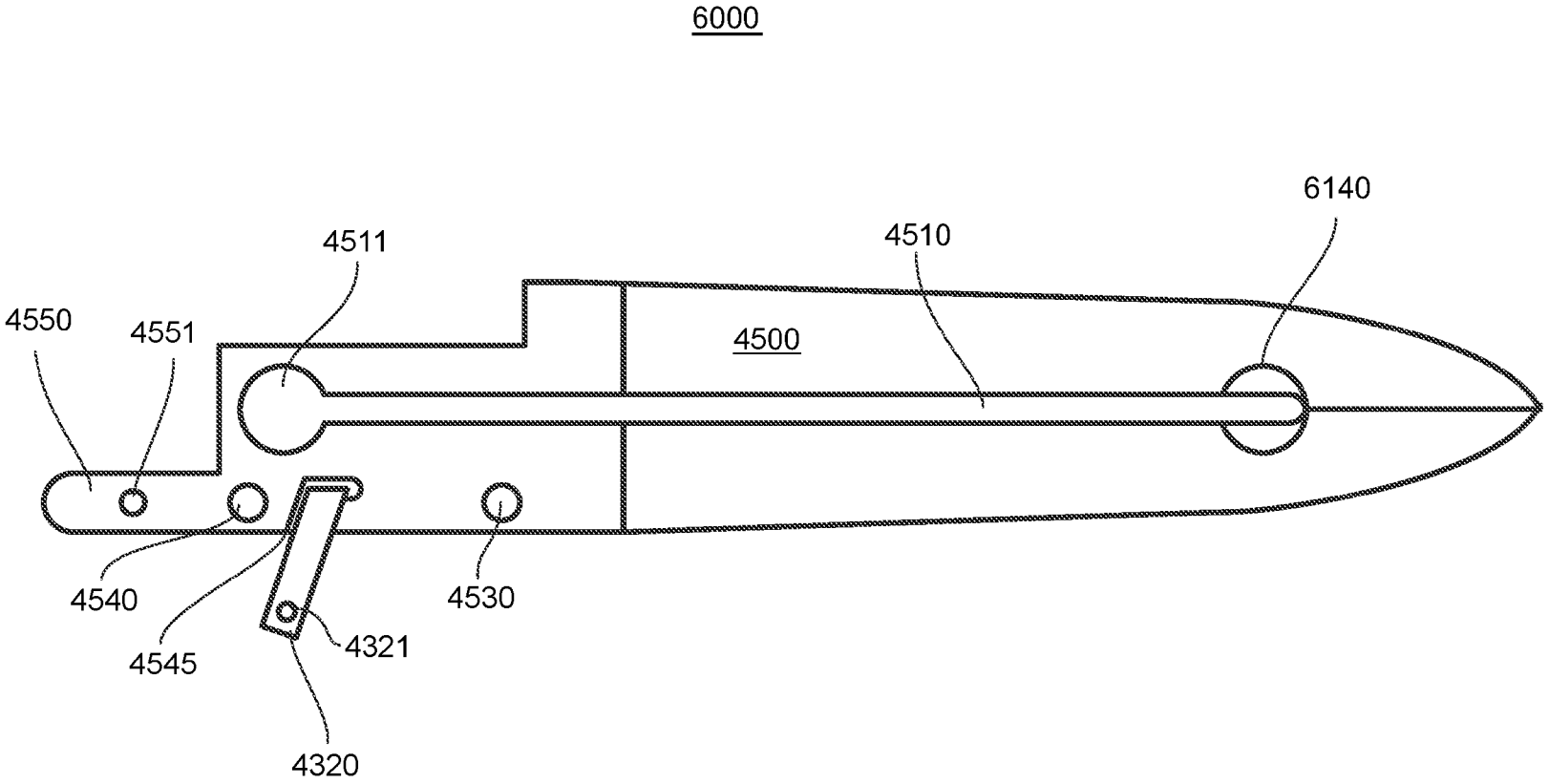
FIG. 6 is an enlarged flat view of an exemplary embodiment of a bottom side of a blade 6000.

A combination of tension caused by a small retractor coil spring (e.g., small resetting coil spring 4770 illustrated in FIG. 4), resistance of a ramp (e.g., ramp 4800 as illustrated in FIG. 4), tension of two leaf springs (e.g., top leaf spring 4880 and bottom leaf spring 4900 as illustrated in FIG. 4), tightness of spacing caused by a combination of a screw (e.g., screw 4885 as illustrated in FIG. 4) and an angle pin (e.g., angle pin 4945 as illustrated in FIG. 4) creates resistance to hold back a large coil spring (e.g., angle pin 4945 as illustrated in FIG. 4) that has to be overcome by assisted depressing of a tang of blade 4500 (e.g., tang 4550 as illustrated in FIG. 4) or (tang 4550 as illustrated in FIG. 6).

When retracting blade 4500 a user can first grasp small key ring 4330, which can be operatively coupled to a retracting key 4320 via an aperture defined by the retracting key near a posterior end of retracting key 4320. In certain exemplary embodiments the aperture can be a hole drilled by a bit such as a #60 drill bit. The user can use small key ring 4330 to pull retracting key 4320 out of the end of large coil spring 4600 and out of a handle 1450 of knife 4000 (e.g., the handle defined by bottom handle scale 4200 and inner top handle scale 4700 of FIG. 4) slot. The user can then insert the end of the retracting key 4320 into a foot hold notch (e.g., notch 4545 as illustrated in FIG. 4 and notch 4545 of FIG. 6 and notch 4545 in FIG. 9)) of blade 4500. A 4430 button will lock blade 4500 until depressed and then by pulling back the inserted retracting key 4320 (see also retracting key 4320 of FIG. 6) to the fully retracted position the button 4430 will lock the fully retracted blade 4500. The retracting key 4320 will then be removed from the notch as shown in FIG. 6. When not being used to lock blade 4500, retracting key 4320 can be inserted into an aperture such as is illustrated in FIG. 12 as defined by recessed portions 12400 and 4290 of system 12000. In certain exemplary embodiments, retracting key 4320 can be fabricated from square bar stock having a nominal size of approximately 1/8 inch. Recessed portions 12200 and 4305 of FIG. 12 form a slot 12600 adapted to slidably receive the tang of blade 4500.

When retracting blade 4500 from an extended position, slant portion 4946 of angle pin 4945 can pass over a posterior end 4555 of blade 4500. The user might then hear two sounding clicks. The first clicking sound can be caused by slant portion 4946 of angle pin 4945 going over the posterior end 4555 of blade 4500 and into the partial bulb 4511 of aperture 4510. The second clicking sound can be caused by button posterior end 4410 of button 4430 entering an indented portion of blade 4500 (see, e.g., indented portion 6140 of system 6000 in FIG. 6), which can be adapted to substantially lock blade 4500 in a retracted position as a safety lock. In certain exemplary embodiments, the retracted position can have approximately 1/32 inch leeway between angle pin 4945 and the partial bulb of aperture 4510. In certain operative embodiments, the leeway can be sufficient to allow the indented portion of blade 4500 to move out of the button posterior end 4410 of button 4430 and allow the assisted opening process to begin by depressing tang 4550 of blade 4500. Thus, button 4430 can be a locking auto like safety button, which can be depressed after retracting blade 4500 to keep the knife in a safety "off" position when carrying the knife, for extra speed when opening—without having to release a safety interlock first by depressing a button to the recessed position into the top handle scales top side. Certain exemplary embodiments might not comprise the indented portion of blade 4500 if a safety interlock is not desired. Certain exemplary embodiments can have a greater angle for angle pin 4945 such that more pressure can be applied to tang 4550 of blade 4500 to assist in opening.

FIG. 3 is a perspective view of an exemplary embodiment of a knife 4000, which illustrates a blade 4500 in a still motion depiction. The blade 4500 is past the second partially extended position and large coil spring 4600 as in FIG. 4 has taken over to fully open the blade 4500. The button 4430 remains unlocked until the blade 4500 is fully extended as in FIG. 1. The angle of the pin connecter 4935 is at its pinnacle and the resetting coil spring FIG. 4, 4770 is returning the angle pin connecter 4935 back and down flush into the slot 3600 of the top handle scale 4700. Further description of FIG. 3 shows a bevel countersink 4740 for the button 4430 to be easily depressed. A top threaded hole 3110 that the angle pin 4945 screws into from the bottom side. A screw 4950 that its head nestles down into a counter bored hole 4840 of the top side of the angle pin connecter 4935. A slant 4946 of the angle pin connecter 4935, that accepts the screw 4950 by threaded hole (see small threaded hole 4850 of FIG. 4). This screw 4950 connects the bottom leaf spring 4900 to the angle pin connecter 4935. A top leaf spring 4880 and a screw 4885 fasten both leaf springs to the top handle scale 4700. A retracting slot 3800 (also see slot 3800 of FIG. 9) provides a space in the handle for retracting key FIG. 4, 4320 to retract the blade 4500 to a fully closed position. Knife 4000 can comprise a button 4430, which can be adapted to act as a safety interlock for knife 4000 to restrain blade 4500 from being extended unless such extension is facilitated by actions of a user. Knife 4000 can comprise a top leaf spring 4880 and an angle pin connector 4935.

FIG. 5 is a perspective view of an exemplary embodiment of a system 5000, which comprises a top handle scale 5100. Top handle scale 5100 can be an embodiment of top handle scale 4700 of FIG. 4. Top handle scale 5100 defines a track groove 5120 and a groove track 5110, which correspond and perform analogous functions to, in operative embodiments, an opposing groove track and track groove in an opposing bottom handle scale (e.g., groove track 4230 and track groove 4240 of bottom handle scale 4200 of FIG. 4). Top handle scale 5100 defines a slot 4810 adapted to receive an angle pin connecter (e.g., angle pin connecter 4935 of FIG. 4).

FIG. 6 is a sectional view of an exemplary embodiment of a knife blade system 6000, which comprises a blade 4500 and a retracting key 4320. Blade 4500 defines an indented portion 6140 and a partial bulb 4511 of an aperture 4510. Blade 4500 defines a notch 4545, which is adapted to receive retracting key 4320. Operating in conjunction with a handle of an exemplary retractable blade knife, via notch 4545, retracting key 4320 can act to restrain motion of blade 4500 relative to a handle of the knife and thereby retracts blade 4500 to a fully retracted position (see notch 4545 of FIG. 9).

Figure 7:
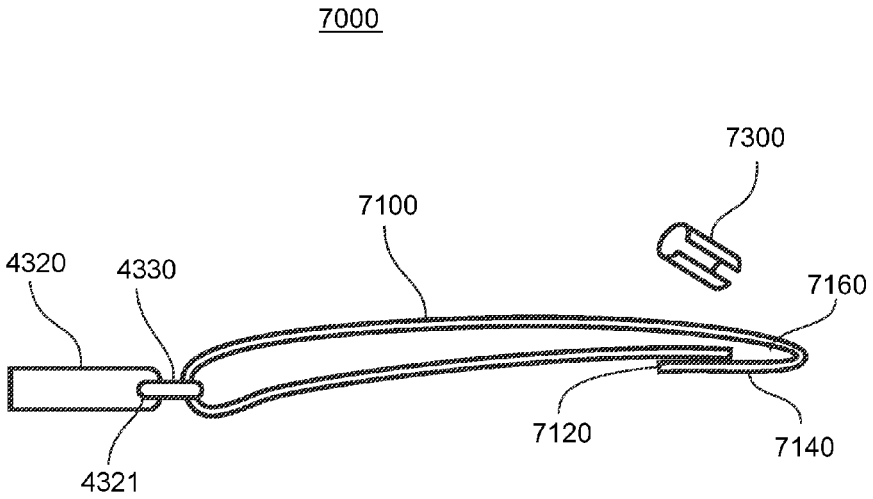
FIG. 7 is an enlarged side view of an exemplary embodiment of a retracting key and lanyard system 7000.

FIG. 7 is a perspective view of an exemplary embodiment of a system 7000, which comprises a retracting key 4320. FIG. 7 shows an optional lanyard for a retracting key 4320. Retracting key 4320 can have a substantially square cross section. A lanyard 7100, such as a substantially flat nylon strap, can be operatively coupled to a key ring 4330, which can be a spring wire key ring. Key ring 4330 can be operatively coupled to retracting key 4320 via an aperture 4321 defined by retracting key 4320 (see aperture 4321 of FIG. 6). In certain exemplary embodiments, aperture 4321 can be drilled with a drill bit that is approximately a #60 drill bit. In certain exemplary embodiments, lanyard 7100 can be operatively attached to FIG. 8, pocket clip 4100 by a 7160 loop that slides onto the end of the pocket clip. Ends 7120 and 7140 of lanyard 7100 can be either stitched or metal clamped together (e.g., via a metal clamp 7300).

When retracting key 4320 is inserted into aperture 12700 such as is illustrated in FIG. 12 as defined by recessed portions 12400 and 4290 of system 12000. The ends 7120 and 7140 can be coupled to form a loop 7160 that can be attached to a knife pocket clip such as pocket clip 4100 of FIG. 9. After retracting key 4320 has been pulled out the aperture and inserted into a foot hold notch of a knife blade (e.g., notch 4545 as illustrated in FIG. 4 and notch 4545 of FIG. 6), loop 7160 can be positioned at a different location on the pocket clip while remaining operatively coupled to the pocket clip.

When retracting the blade, loop 7160 can slide along the pocket clip such that retracting key 4320 can be inserted into the aperture. Such embodiments keep lanyard 7100 out of the way when using the assisted opening knife. Certain exemplary embodiments can comprise an additional lanyard coupled to key ring 4330.

FIG. 8 is a sectional view of an exemplary embodiment of a system 8000, which can comprise a bottom handle scale 4200. The 4200 bottom handle scale is attached to the top handle scale through bottom end holes 4210, 4242, 4260, 4280, and 4310. The holes are the same as FIG. 4, bottom handle scale 4200 holes 4210, 4242, 4260, 4280, and 4310—only from the bottom side (not the inner side). The pocket clip 4100 is attached by torx screws 4121 and 4120. See FIG. 4 for the same screws 4121 and 4120 to screw in threaded holes (from the bottom) 4270 and 4300.

Figure 9:
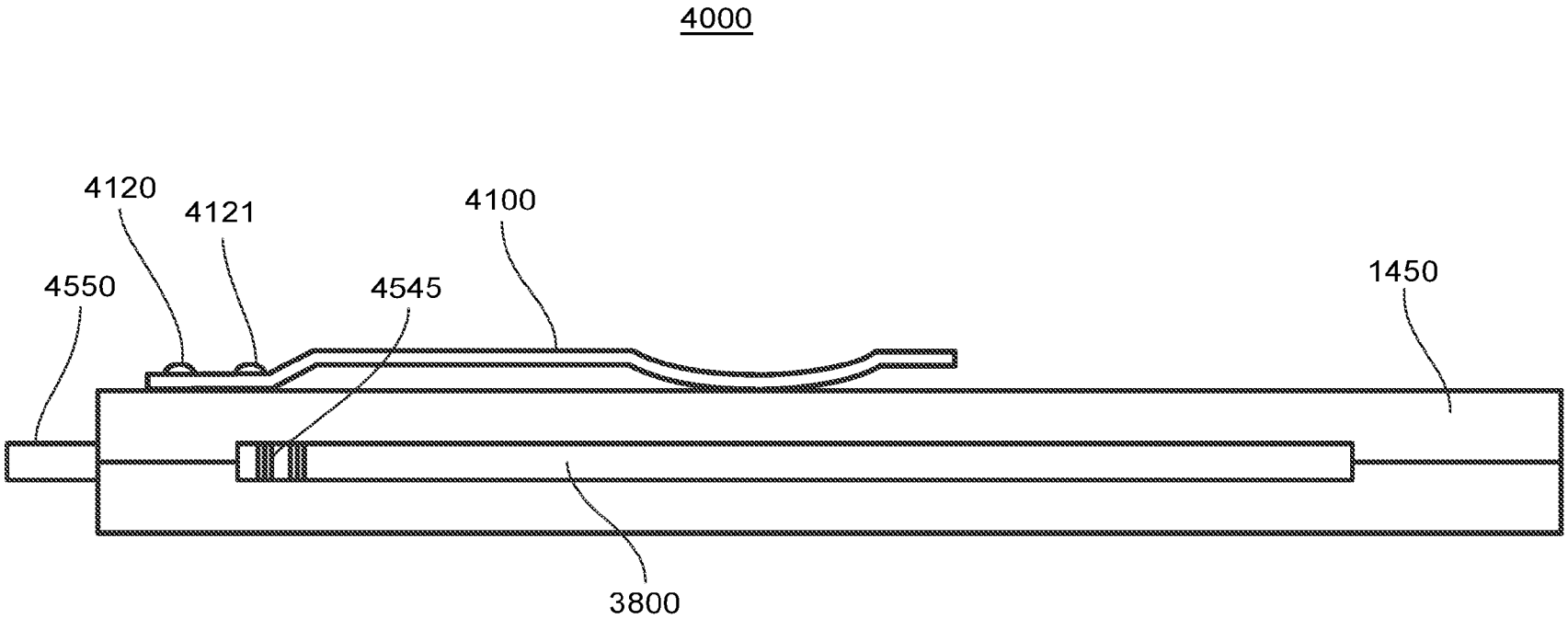
FIG. 9 is an elongated side view of an exemplary embodiment of a closed knife 4000 showing a retracting slot and special notch in bladeing, a protruding tang and a pocket clip.

FIG. 9 is a plan view of an exemplary embodiment of a knife 4000, which comprises a handle 1450, a tang 4550, a pocket clip 4100, and two or more fasteners 4121 and 4120. Pocket clip 4100 can be substantially fixedly attached to knife 4000 via fasteners 4121 and 4120. Milled slot 3800 is adapted to retract the blade via retracting key 4320 of FIG. 7. Foot hold notch 4545 is shown all the way retracted for a completely closed blade (see also, retracting key 4320 and foot hold notch 4545 of FIG. 6.

Figure 10:
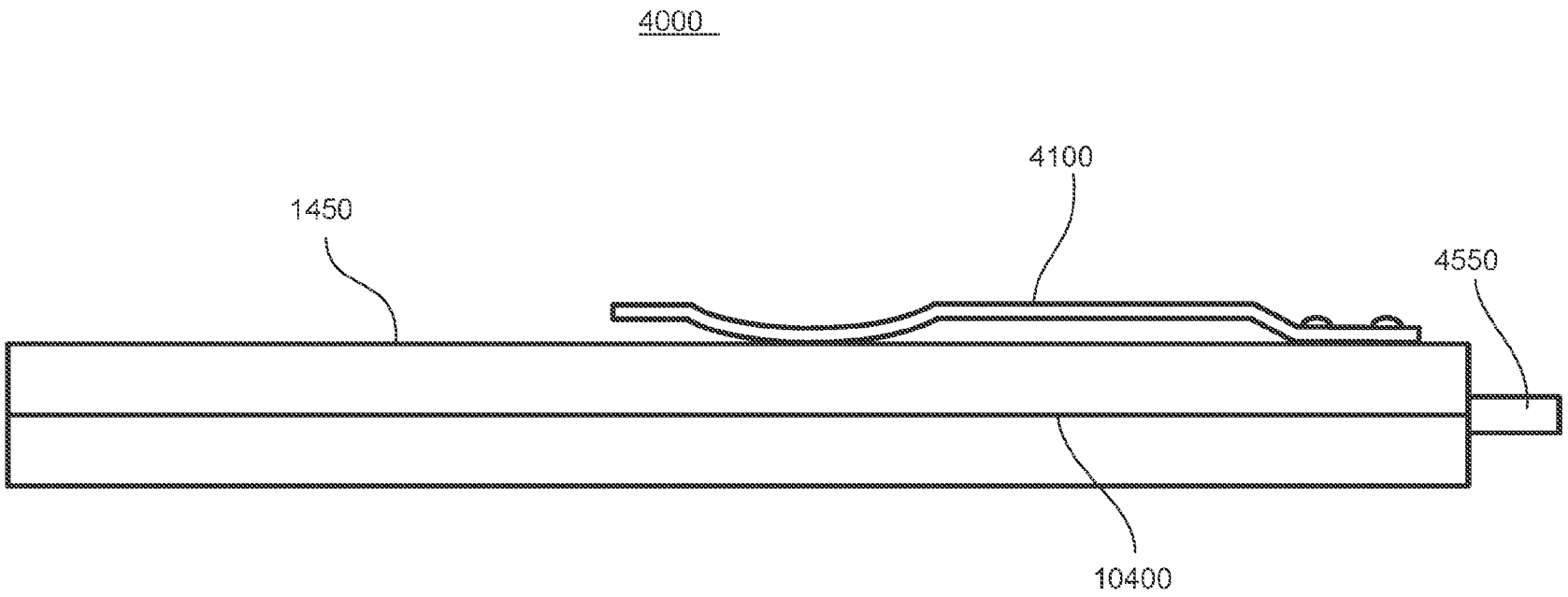
FIG. 10 is elongated side view of an exemplary embodiment of a closed knife 4000 showing a backbone seam, protruding tang, and a pocket clip.

FIG. 10 is a side view of an exemplary embodiment of a knife 4000, which comprises a handle 1450 and a pocket clip 4100 and blade tang 4550. Backbone seam 10400 is where the top and bottom handle scales meet.

Figure 11:
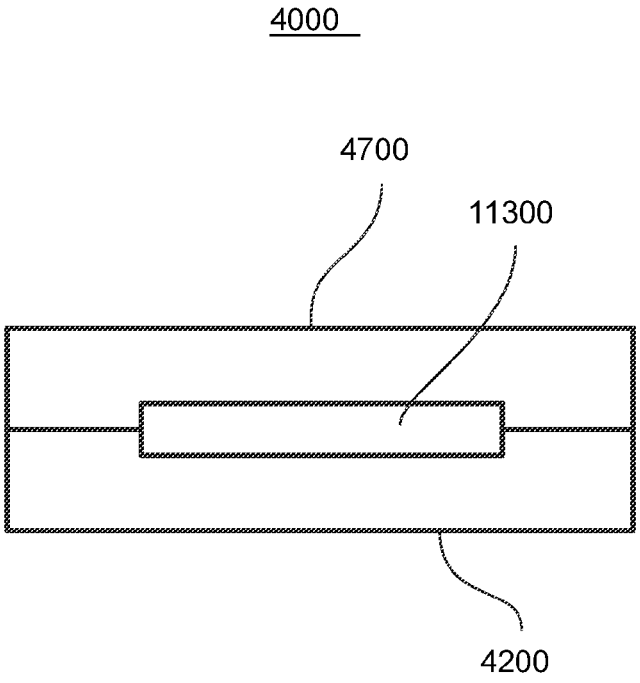
FIG. 11 is an enlarged front view of an exemplary embodiment of a closed knife 4000 showing a front opening blade slot.

FIG. 11 is a front end view of an exemplary embodiment of a knife 4000, which comprises an 4700 top handle scale and an 4200 bottom handle scale. The blade thrusts out from front end opening 11300.

FIG. 12 is a butt end view of an exemplary embodiment of a knife 4000, which comprises a top handle scale 4700 and bottom handle scale 4200, and defines a slot 12600 and an aperture 12700. Slot 12600 is defined by recessed portions 12200 and 4305 of system 12000. Slot 12600 is adapted to receive a tang of a blade of knife 4000. Second aperture 12700 is defined by recessed portions 12400 and 4290 of knife 4000. Second aperture 12700 is adapted to receive a retracting key. The retracting key can be adapted to perform the functions described and associated with retracting key 4320 of FIG. 4.

Figure 13:
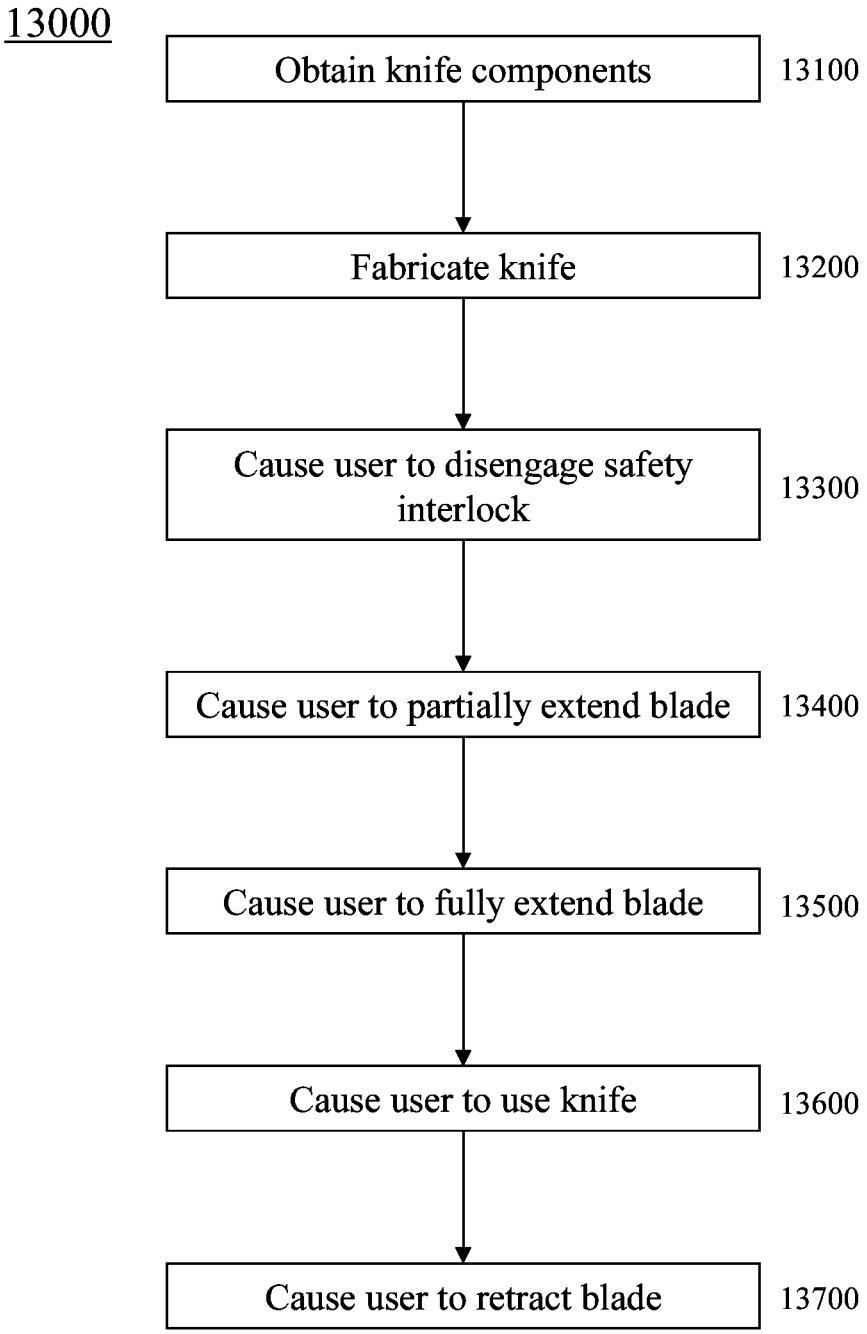
FIG. 13 is an end view of an exemplary embodiment of a method 13000.

FIG. 13 is a flowchart of an exemplary embodiment of a method 13000. At activity 13100, knife components can be obtained by a knife fabricator. In certain exemplary embodiments, the knife components can comprise substantially all components of system 4000 as illustrated in FIG. 4. The knife can comprise a handle comprising a top handle scale and a bottom handle scale. The top handle scale can define a button aperture and a grooved channel. The knife can comprise a blade, which can define a blade aperture. The blade aperture can define a slot along a majority of a length of the blade. The blade aperture can have a first end that defines a partial bulb and a second end that is rounded. The blade can comprise a tang. The blade can comprise two pins that each protrude from opposing surfaces of a posterior portion of the blade. A first set of extended ends of the two pins can be adapted to fit into and slide within a track groove of the bottom handle scale. A second set of extended ends of the two pins can be adapted to fit into and slide within a parallel matching track groove of the inner top handle scale.

The knife can comprise a button, which can comprise a rim. The Button can be adapted to insert into the partial bulb. The rim can be adapted to restrain the button from exiting through the button aperture. Rim 4420 also restrains the front depressing end of button 4430 from entering the partial bulb 4511. When pressed by a user, the button can be adapted to cause the blade to extend from a fully retracted position to a first partially extended position. The knife can comprise a top leaf spring, a bottom leaf spring, and an angle pin connecter. The angle pin connecter can comprise a slant portion, a recessed portion, and an angle pin. The bottom leaf spring can be adapted to slide into the recessed portion. The angle pin can be adapted to engage the blade via the blade aperture. The angle pin connector can be adapted to slidably move in the grooved channel.

The knife can comprise a fastener adapted to couple the recessed portion of the angle pin connector to the bottom leaf spring. The large coil spring can be held within the grooved channel. Responsive to the user pressing the tang. The large coil spring can be adapted to cause the blade to thrust out from a second partially extended position to a fully extended position.

At activity 13200, the knife can be fabricated. The top handle scale can be coupled to the bottom handle scale via a plurality of fasteners At activity 13300, a user can be caused to disengage a safety interlock of the knife. At activity 13400, the user can be caused to partially extend a blade of the knife. At activity 13500, the user can be caused to substantially fully extend the blade of the knife.

At activity 13600, the user can be caused to use the knife to cut and/or slice something. At activity 13700, the user can be caused to retract the blade of the knife.

DEFINITIONS

When the following terms are used substantively herein, the accompanying definitions apply. These terms and definitions are presented without prejudice, and, consistent with the application, the right to redefine these terms during the prosecution of this application or any application claiming priority hereto is reserved. For the purpose of interpreting a claim of any patent that claims priority hereto, each definition (or redefined term if an original definition was amended during the prosecution of that patent), functions as a clear and unambiguous disavowal of the subject matter outside of that definition.

a—at least one.
activity—an action, act, step, and/or process or portion thereof.
adapted to—made suitable or fit for a specific use or situation.
and/or—either in conjunction with or in alternative to.
angle pin—a pin that is adapted to be inclined relative to a surface to which the pin is attached.
angle pin connecter—a device and/or system adapted to couple one or more leaf springs to a handle of a knife, the knife adapted for assisted extension and retraction of the blade of the knife.
aperture—an opening, hole, slot, or gap defined by an object.
apparatus—an appliance or device for a particular purpose.
article of clothing—a garment worn by a user.
bevel countersink—a substantially conical hole cut and/or machined into a manufactured object.
blade—a portion of a knife that comprises a cutting edge.
bottom—a lower portion of an object placed in an orientation in which the lower portion is under a top portion.
bulb—a partially round shape resembling a teardrop.
button—a switch mechanism having a disc-like surface that is adapted to controlling some aspect of a device and/or system.
can—is capable of, in at least some embodiments.
cause—to produce an effect.
cavity—a substantially empty space defined by a solid object.
channel—a groove or flute in an object.
coil—a length of metal wound in circles or spirals.
coil spring—a substantially helical spring made from metal.
comprising—including but not limited to.
cone shape—a shape whose base is a circle and whose sides taper up to a point
configure—to make suitable or fit for a specific use or situation.
connect—to join or fasten together.
coupleable—capable of being joined, connected, and/or linked together.
coupling—linking in some fashion.
create—to bring into being.
cup—to cut and/or form into a bowl-shape.
define—to establish the outline, form, or structure of.
depress—to push something.
device—a machine, manufacture, and/or collection thereof.
engage—to be positioned in a manner so as to come into operative contact with something.
exit—an act of moving from a first position to a second position that is exposed to an environment relative to the first position.
extend—to thrust or extend out.
extended ends—tips that extend out from a surface.
face—a surface of a knife blade that is adapted to be pushed by a knife part to extend the blade from a handle of the knife.
fastener—a hardware device that mechanically joins or affixes two or more objects together.
fit—to be of the right shape and size to engage with something else.
groove—a cut or depression defined by an object.
handle—a part by which a knife is held, carried, or controlled.
indented—defining a dent, inlay, or space left blank.
install—to connect or set in position and prepare for use.
key ring—a metal ring onto which keys may be threaded.
knife—a cutting instrument comprising a blade and a handle into which the blade is fixed.
lanyard—a cord adapted for holding a knife or a portion of the knife.
leaf spring—a substantially flat and flexible piece of metal or a composite material that deflects by bending when forces act upon it.
may—is allowed and/or permitted to, in at least some embodiments.
method—a process, procedure, and/or collection of related activities for accomplishing something.
motion—a change in the position or location of something.
motive force—a force that cause something to move.
move—to change a position and/or location.
notch—an indentation or incision on an edge or surface.
partial—an incomplete portion of something.

pin—a piece of material adapted to fasten, attach, or engage with something.

plurality—the state of being plural and/or more than one.

pocket clip—a device and/or system adapted to be releasably attached to a small bag sewn into or on clothing.

position—a place where something is located or has been put.

posterior—at or near the rear end of a knife relative to an end of the knife from which a blade extends.

predetermined—established in advance.

press—to contact something by exerting a physical force.

protrude—to extend beyond a surface.

provide—to furnish, supply, give, and/or make available.

push—to exert a force in order to move something away from an origin of the force.

ramp—a sloped surface.

receive—to get as a signal, take, acquire, and/or obtain.

recess—a substantially hollow space defined by something.

releasably fasten—to operatively couple to things in a manner such that the things can be substantially non-destructively uncoupled.

restrain—to prevents, resist, and/or limit the free movement of something.

retract—to draw or pull something back or back in.

retracting key—a device and/or system adapted to restrain retraction of a knife blade via engagement with a notch defined by the blade.

resetting spring—a helical metal coil that can be pressed or pulled but returns to its former shape when released and is adapted to return the assisted opening mechanism so as to be ready for the blade retraction process.

rim—an upper or outer edge of an object.

rounded—having a smooth, curved surface.

safety interlock—a device and/or system adapted to prevent or resist the extension of a blade from a knife handle without a user taking one or more predetermined actions to extend the blade.

scale—outer handle plates of a knife.

screw—a threaded fastener comprising a head that defines a cavity, the cavity adapted to receive a bit of a torsion device.

set—a related plurality.

slant—a sloped portion of an object relative to a surface on which the object sits.

slide—to move along a surface while in contact with the surface.

slot—an aperture or slit defined by an object.

store—to retain.

substantially—to a great extent or degree.

support—to bear the weight of, especially from below.

system—a collection of mechanisms, devices, machines, articles of manufacture, processes, data, and/or instructions, the collection designed to perform one or more specific functions.

tang—a projection on a blade of a knife by which the blade is held in the handle.

tension—a condition of being held in a state between two or more forces, which are acting in opposition to each other.

tightness of spacing—a closeness of fit between objects.

top—an upper portion of an object placed in an orientation in which the upper portion is above a bottom portion.

torx screws—a screw comprising a head that is adapted to be engaged by a star screwdriver or star bit.

track groove—a cut or depression defined by an object that is adapted to engage with another object.

user—a person who uses or operates a knife.

via—by way of and/or utilizing.

Note

Still other substantially and specifically practical and useful embodiments will become readily apparent to those skilled in this art from reading the above-recited and/or herein-included detailed description and/or drawings of certain exemplary embodiments. It should be understood that numerous variations, modifications, and additional embodiments are possible, and accordingly, all such variations, modifications, and embodiments are to be regarded as being within the scope of this application.

Thus, regardless of the content of any portion (e.g., title, description, abstract, drawing figure, etc.) of this application, unless clearly specified to the contrary, such as via explicit definition, assertion, or argument, with respect to any claim, whether of this application and/or any claim of any application claiming priority hereto, and whether originally presented or otherwise:

there is no requirement for the inclusion of any particular described or illustrated characteristic, function, activity, or element, any particular sequence of activities, or any particular interrelationship of elements;

no characteristic, function, activity, or element is "essential";

any elements can be integrated, segregated, and/or duplicated;

any activity can be repeated, any activity can be performed by multiple entities, and/or any activity can be performed in multiple jurisdictions; and any activity or element can be specifically excluded, the sequence of activities can vary, and/or the interrelationship of elements can vary.

Moreover, when any number or range is described herein, unless clearly stated otherwise, that number or range is approximate. When any range is described herein, unless clearly stated otherwise, that range includes all values therein and all subranges therein. For example, if a range of 1 to 10 is described, that range includes all values therebetween, such as for example, 1.1, 2.5, 3.335, 5, 6.179, 8.9999, etc., and includes all subranges therebetween, such as for example, 1 to 3.65, 2.8 to 8.14, 1.93 to 9, etc.

When any claim element is followed by a drawing element number, that drawing element number is exemplary and non-limiting on claim scope. No claim of this application is intended to invoke paragraph six of 35 USC 112 unless the precise phrase "means for" is followed by a gerund.

Any information in any material (e.g., a United States patent, United States patent application, book, article, etc.) that has been incorporated by reference herein, is only incorporated by reference to the extent that no conflict exists between such information and the other statements and drawings set forth herein. In the event of such conflict, including a conflict that would render invalid any claim herein or seeking priority hereto, then any such conflicting information in such material is specifically not incorporated by reference herein.

Accordingly, every portion (e.g., title, field, background, summary, description, abstract, drawing figure, etc.) of this application, other than the claims themselves, is to be regarded as illustrative in nature, and not as restrictive, and the scope of subject matter protected by any patent that issues based on this application is defined only by the claims of that patent.

What is claimed is:

1. A retractable blade knife, comprising:

a handle comprising a top handle scale and a bottom handle scale, said top handle scale coupled to said bottom handle scale via a plurality of fasteners, said top handle scale defining a button aperture and a grooved channel;

a blade, said blade defining a blade aperture, said blade aperture defining a slot along a majority of a length of said blade, said blade aperture having a first end that defines a partial bulb and a second end that is rounded, said blade comprising a tang, said blade comprising two pins that each protrude from both opposing surfaces of a posterior portion of said blade, a first set of extended ends of said two pins adapted to fit into and slide within a track groove of said bottom handle scale, a second set of extended ends of said two pins adapted to fit into and slide within a parallel matching track groove of an inner surface of said top handle scale;

a button, said button comprising a rim, said button adapted to insert into said partial bulb, said rim adapted to restrain said button from exiting through said button aperture, when said button is pressed by a user said rim adapted to restrain a top end of said button from entering a top side of said partial bulb as a posterior end of said button exits from a bottom side of said partial bulb, when said button is pressed by said user, said button adapted to cause said blade to extend from a fully retracted position to a first partially extended position said blade substantially enclosed within said handle at said first partially extended position;

a top leaf spring;

a bottom leaf spring;

an angle pin connecter comprising a slant portion, a recessed portion, and an angle pin, said bottom leaf spring adapted to slide into said recessed portion, said angle pin adapted to engage said blade via said blade aperture, said angle pin connector adapted to slidably move in a grooved channel;

a bottom leaf spring fastener adapted to couple said recessed portion of said angle pin connector to said bottom leaf spring;

a large coil spring, said large coil spring held within said groove track, responsive to said user pressing said tang, said large coil spring adapted to cause said blade to thrust out from a second partially extended position, a tip of said blade protruding from an opening of said handle at said second partially extended position, to a fully extended position.

2. The retractable blade knife of claim 1, further comprising:

a retracting key, said retracting key adapted to be stored in a cavity defined by said top handle scale and said bottom handle scale, when stored said retracting key partially surrounded by said large coil spring, said retracting key adapted to engage with a special notch of said blade to restrain motion of said blade relative to said bottom handle scale and said top handle scale, said special notch adapted to substantially lock said retracting key in position when said retracting key is tilted back such that a longitudinal axis of said retracting key defines an acute angle with a longitudinal axis of said handle.

3. The retractable blade knife of claim 1, further comprising:

a retracting key, said retracting key adapted to be stored in a cavity defined by said top handle scale and said bottom handle scale, when stored said retracting key partially surrounded by said large coil spring, said retracting key adapted to engage with a special notch of said blade to restrain motion of said blade relative to said bottom handle scale and said top handle scale, said special notch adapted to substantially lock said retracting key in position when said retracting key is tilted back such that a longitudinal axis of said retracting key defines an acute angle with a longitudinal axis of said handle; and a key ring, said key ring adapted to be grasped by said user to remove said retracting key from said cavity.

4. The retractable blade knife of claim 1, further comprising:

a retracting key, said retracting key adapted to be stored in a cavity defined by said top handle scale and said bottom handle scale, when stored said retracting key partially surrounded by said large coil spring, said retracting key adapted to engage with a special notch of said blade to restrain motion of said blade relative to said bottom handle scale and said top handle scale, said special notch adapted to substantially lock said retracting key in position when said retracting key is tilted back such that a longitudinal axis of said retracting key defines an acute angle with a longitudinal axis of said handle;

a key ring, said key ring adapted to be grasped by said user to remove said retracting key from said cavity;

a pocket clip, said pocket clip adapted to be releasably fastened to an article of clothing of said user; and a lanyard, said lanyard adapted to be coupled to said key ring, said lanyard adapted to be releasably coupled to said pocket clip as said retracting key is moved from said cavity to said notch.

5. The retractable blade knife of claim 1, further comprising:

an angle pin comprising a slant, said slant adapted to pass over a back end of said blade, levering up said angle pin and allowing said angle pin to enter into said partial bulb of blade aperture during a blade retraction process.

6. The retractable blade knife of claim 1, further comprising:

a small resetting spring adapted to be pushed by a bent down end of said bottom leaf spring responsive to said user pushing said tang.

7. The retractable blade knife of claim 1, further comprising:

a small resetting spring adapted to push a bent down end of said bottom leaf spring to provide a return force of said bottom leaf spring and said angle pin connecter to an original position, thereby preparing said retractable blade knife such that a user can initiate a blade retracting process.

8. The retractable blade knife of claim 1, wherein:

said button aperture has a top side bevel countersink adapted to facilitate a depression of said button by said user.

9. The retractable blade knife of claim 1, wherein:

said button comprises:

a posterior end, said posterior end defining a posterior end slot that is cupped out;

a cone shape coil spring adapted to fit into said slot that is cupped out, said posterior end and said cone shape coil spring adapted to slidably fit into a bottom handle scale aperture defined by said bottom handle scale.

10. The retractable blade knife of claim 1, wherein:

when said blade is fully retracted, said tang protrudes from a groove is defined by said bottom handle scale and said top handle scale, a hole in said tang signifying to a user that a safety interlock is in an on position.

11. The retractable blade knife of claim 1, wherein:

said bottom handle scale and said top handle scale are coupled via torx screws.

12. The retractable blade knife of claim 1, wherein:

said large coil spring is adapted to push a face of said blade to extend said blade to said fully extended position.

13. The retractable blade knife of claim 1, wherein:

said button is adapted to slidably move in said blade aperture.

14. The retractable blade knife of claim 1, wherein:

said grooved channel has a ramp and a slot that allows said slant portion of said angle pin connecter to slide up said ramp and said angle pin to move in said slot and substantially simultaneously lever up out of said partial bulb of said blade aperture, thus releasing said blade for opening by said large coil spring.

15. The retractable blade knife of claim 1, wherein:

said button is adapted to be a safety interlock when said blade is in said fully retracted position.

16. The retractable blade knife of claim 1, wherein:

said button is adapted to engage with an indented portion of said blade and thereby be a safety interlock when said blade is in said fully retracted position.

17. The retractable blade knife of claim 1, wherein:

when said blade is in said first partially extended position, said large coil spring is restrained from extending by a combination of tension caused by a small resetting coil spring, resistance of a ramp, tension of said top leaf spring and said bottom leaf spring, and tightness of spacing caused by a combination of a screw and said angle pin.

18. A method comprising:

fabricating a retractable blade knife, said retractable blade knife comprising:

a handle comprising a top handle scale and a bottom handle scale, said top handle scale coupled to said bottom handle scale via a plurality of fasteners, said top handle scale defining a button aperture and a grooved channel;

a blade, said blade defining a blade aperture, said blade aperture defining a slot along a majority of a length of said blade, said blade aperture having a first end that defines a partial bulb and a second end that is rounded, said blade comprising a tang, said blade comprising two pins that each protrude from opposing surfaces of a posterior portion of said blade, a first set of extended ends of said two pins adapted to fit into and slide within a track groove of said bottom handle scale, a second set of extended ends of said two pins adapted to fit into and slide within a parallel matching track groove of said inner top handle scale;

a button, said button comprising a rim, said button adapted to insert into said partial bulb, said rim adapted to restrain said button from exiting through said button aperture, when said button is pressed by a user, said rim adapted to restrain a top end of said button from entering a top side of partial bulb as posterior end of button exits from a bottom side of said partial bulb, when button is pressed by said user, said button adapted to cause said blade to extend from a fully retracted position to a first partially extended position;

a top leaf spring;

a bottom leaf spring;

an angle pin connecter comprising a slant portion, a recessed portion, and an angle pin, said bottom leaf spring adapted to slide into said recessed portion, said angle pin adapted to engage said blade via said blade aperture, said angle pin connector adapted to slidably move in said grooved channel;

a fastener adapted to couple said recessed portion of said angle pin connector to said bottom leaf spring;

a large coil spring, said large coil spring held within said grooved channel, responsive to said user pressing said tang, said large coil spring adapted to cause said blade to thrust out from a second partially extended position to a fully extended position.

* * * * *